United States Patent [19]

Smith, Jr.

[11] Patent Number: 4,765,402

[45] Date of Patent: Aug. 23, 1988

[54] SELF-LOCATING SEAL ASSEMBLY

[75] Inventor: Sydney K. Smith, Jr., Huntsville, Tex.

[73] Assignee: Hughes Tool Company, Houston, Tex.

[21] Appl. No.: 41,380

[22] Filed: Apr. 22, 1987

[51] Int. Cl.[4] ..... E21B 23/02

[52] U.S. Cl. ..... 166/115; 166/137; 166/215; 166/237

[58] Field of Search ..... 166/115, 215, 214, 237, 166/378, 380, 381, 382, 125, 137, 387; 294/86.17, 86.25, 86.26, 86.21, 86.24, 86.16

[56] References Cited

U.S. PATENT DOCUMENTS

| | | | |
|---|---|---|---|
| 2,862,560 | 12/1958 | Bostock et al. | 166/125 |
| 3,100,532 | 8/1963 | Tamplen | 166/237 X |
| 3,102,592 | 9/1963 | Dollison | 166/125 |
| 4,248,300 | 2/1981 | Braddick | 166/250 |
| 4,265,306 | 5/1981 | Stout | 166/214 X |
| 4,281,711 | 8/1981 | Braddick et al. | 166/118 |
| 4,399,873 | 8/1983 | Lindsey, Jr. | 166/380 |
| 4,406,324 | 9/1983 | Baugh et al. | 166/125 |
| 4,411,455 | 10/1983 | Schnatmeyer | 285/39 |
| 4,657,077 | 4/1987 | Smith, Jr. et al. | 166/115 |

*Primary Examiner*—James A. Leppink
*Assistant Examiner*—Hoang C. Dang
*Attorney, Agent, or Firm*—Charles D. Gunter, Jr.

[57] ABSTRACT

A self-locating seal assembly is shown for sealing between a well string and the bore of a surrounding well conduit, the surrounding conduit being provided with an internal recess for engagement by the seal assembly. A mandrel has an internal bore, an exterior, and a lower end. A seal body is carried about the mandrel and has an external seal region for engaging the interior bore of the surrounding well conduit and an internal seal region for engaging the mandrel exterior. The seal body provided with a plurality of window openings, each opening having an upper and lower tapered ramp surface. An upper and a lower sleeve circumscribe the seal body about the window openings and are spaced to define a circumferential opening with respect to the exterior of the seal body. A plurality of latch elements are carried in the annular circumferential opening and have camming surfaces which cooperate with the ramp surfaces of the window openings. A spring is located in an annular recess above the latch elements to initially bias the latch elements radially outward in the direction of the surrounding well conduit.

6 Claims, 2 Drawing Sheets

FIG. 4
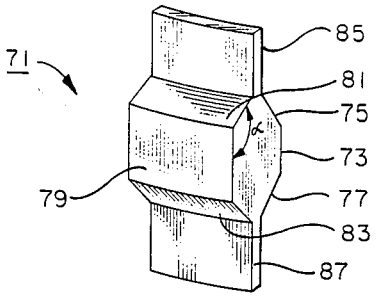
FIG. 5
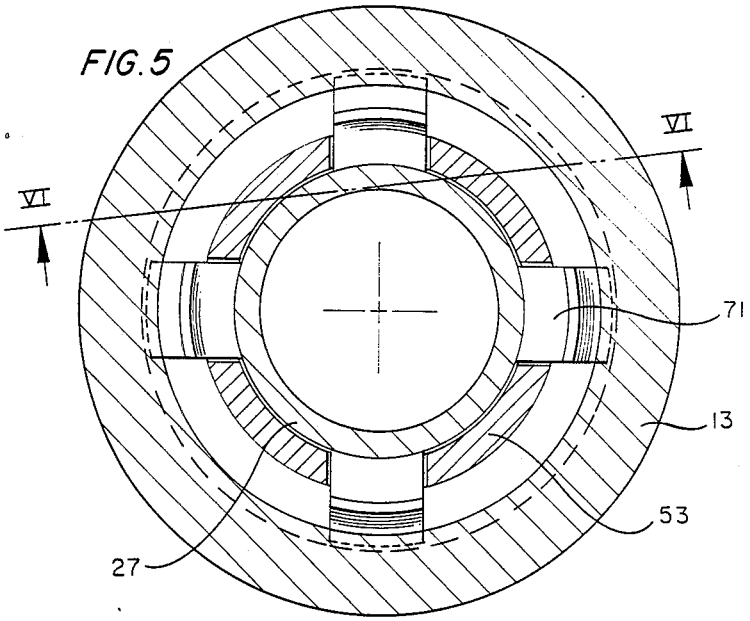
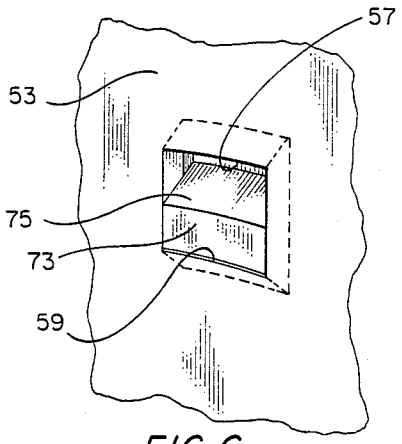
FIG. 6

SELF-LOCATING SEAL ASSEMBLY

BACKGROUND OF THE INVENTION

1. Field of the Invention

The present invention relates to techniques for sealing cylindrical bodies to circumscribing conduits and, specifically, to a self-locating seal assembly for sealing a well string within the bore of a surrounding well conduit.

2. Description of the Prior Art

Sealing devices of various kinds are used in well working operations, and in the production of a well. For example, in downhole cementing procedures, seal assemblies are used to control the placement of cement and the maintenance of pressure to accomplish cementing operations. Seal assemblies in the form of packers are known for isolating formations for treatment, or for isolating segments of liner or casing for squeeze cementing, for example. Packers are also used routinely for sealing production strings to liner or casing to define flow paths from producing formations to the surface.

Prior art seal assemblies of the type used in positioning and bonding a liner in a casing have typically included radially moving dogs for latching the seal assembly within the liner. For instance, U.S. Pat. No. 4,281,711, issued Aug. 4, 1981, to Braddick et al, shows a seal assembly used in bonding a liner within a casing. The liner is made up to include a sequence of tubular members threaded together. One of the tubular members or subs is provided with an internal recess, usually a circumferential groove, in proximity to a landing shoulder within the sub. The seal assembly is landed on the landing shoulder within the liner sub and has radially moving dogs which are actuated to latch the seal assembly into the internal recess provided in the pipe sub.

In U.S. Pat. No. 4,657,077, issued Apr. 14, 1987, to Sidney K. Smith, Jr. et al., for "Locking Production Seal Assembly," a production assembly is shown which is used, for example, to latch a tubing string within the bore of a surrounding conduit. The device features setting dogs which are radially actuated to move into engagement with the internal recess provided in the surrounding conduit. U.S. Pat. No. 4,406,324, issued Sept. 27, 1983, and assigned to the assignee of the present invention also shows a seal assembly with latching dogs for engaging a surrounding recess.

In the prior art seal assemblies, an outer sleeve was usually carried about a sliding inner mandrel. The latching dogs moved in windows or openings in the outer sleeve for latching engagement with the recesses provided in the surrounding conduit. During well bore operations, when pressure is on the tool, the latching dogs were subjected to loads which could damage the exterior surface of the sliding mandrel. The damaged mandrel could, in turn, damage that portion of the seal assembly used to seal between the mandrel and the surrounding conduit.

It is an object of the present invention to provide a seal assembly which is self-locating and which does not require a locating shoulder in the pipe sub of the surrounding conduit into which the assembly is to be latched.

Another object of the invention is the provision of a seal assembly with latching dogs and a sliding mandrel, the assembly having a unique internal seal body which cooperates with the latching dogs to prevent damage to the exterior surface of the sliding mandrel during well bore operations.

Additional objects, features and advantages will be apparent in the written description which follows.

SUMMARY OF THE INVENTION

The self-locating seal assembly of the invention is used for sealing between a well string and the bore of a circumscribing well conduit, the circumscribing conduit being provided with an internal recess for engagement by the seal assembly. The seal assembly includes a mandrel having an interior bore for conducting well bore fluids, an exterior, upper connecting means for connection in a well string leading to the well surface, and a lower end, the lower end being connected to the remainder of the mandrel to form an external support shoulder. The mandrel exterior has a region of reduced external diameter adjacent the lower end which defines a setting shoulder in the mandrel exterior.

A seal body is carried about the mandrel on the support shoulder while running into the well bore. The seal body has an external seal region for sealingly engaging the interior bore of the circumscribing well conduit and an internal seal region for sealingly engaging the mandrel exterior. The seal body is provided with a plurality of window openings at one circumferential location, each window opening having an upper and lower tapered ramp surface. Upper and lower sleeve means circumscribe the seal body at spaced locations to thereby define a circumferential opening. The sleeve means each have an interior surface which is spaced-apart from the seal body to define an annular recess.

A plurality of latch elements are carried by the seal body in the circumferential opening, each latch element having an interior provided with oppositely sloping camming surfaces and an exterior also provided with oppositely sloping camming surfaces. The interior camming surfaces are received within the window openings of the seal body and are engageable with selected ones of the window opening ramp surfaces, whereby the latch elements are movable axially and radially within the window openings.

Spring means are located within a selected one of the annular recesses for biasing the latch element interior, lower camming surfaces into engagement with the window opening lower ramp surfaces, whereby the latch elements are forced radially outward in the direction of the surrounding well conduit as the seal assembly is being run into position within the well bore. As the seal assembly enters the pipe sub containing the internal recess, a change in internal diameter causes the latch elements to be biased radially inward. As the internal recess in the surrounding well conduit is encountered, the latch elements spring radially outward into latching engagement.

BRIEF DESCRIPTION OF THE DRAWINGS

FIG. 4 is an isolated view of one of the latch elements used in the seal assembly of FIG. 1.

FIG. 5 is a top, cross-sectional view taken along lines V—V in FIG. 3.

FIG. 6 is an interior view of a portion of the seal body taken along lines VI—VI of FIG. 5, showing the movement of the latch elements within the window openings of the seal body.

DETAILED DESCRIPTION OF THE INVENTION

Figure 1:
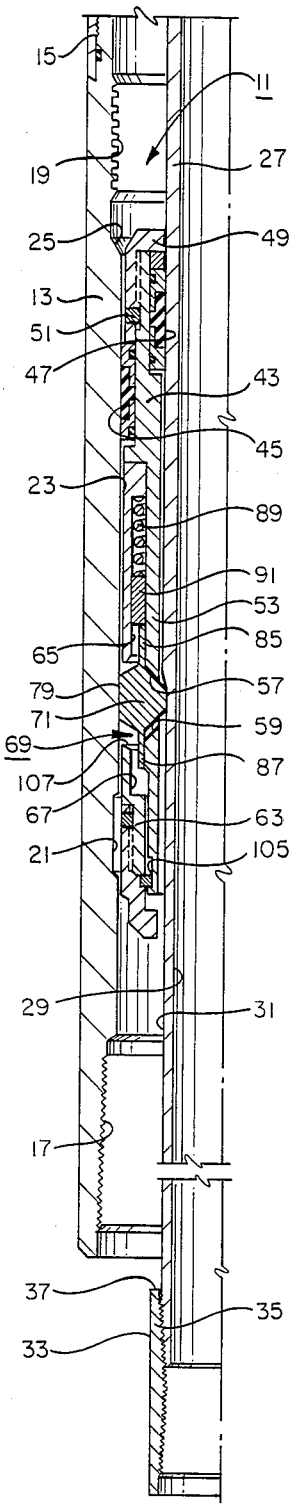
FIG. 1 is a side, cross-sectional view of the seal assembly of the invention, showing the seal body on the mandrel as the assembly is being run into position within the surrounding well conduit.

FIG. 1 shows the self locating seal assembly of the invention designated generally as 11. The seal assembly 11 is shown being run into position within a surrounding well conduit, in this case liner 13. It will be understood that the liner 13 is a tubular conduit having an upper externally threaded extent 15 and a lower internally threaded extent 17 by which a sequence of such tubular members are threaded together to make up a liner string. The portion of the liner string shown in FIG. 1 includes internal running threads 19 which are engaged by a running tool during the "hanging" of the liner in the well bore.

Running tools are typically made up as part of the pipe string between the liner hanger and the pipe string running to the well's surface during the hanging of the liner. The running tool serves as a link to transmit torque to the liner hanger to hang the liner in the well bore. The running tool is then typically manipulated from the well surface effect a release of the running tool from the liner hanger and the liner is then cemented into place in the well bore. One such running tool for use in hanging a liner is shown in U.S. Pat. No. 4,598,774, issued July 8, 1986, entitled "Setting Tool With Retractable Torque Fingers", and assigned to the assignee of the present invention.

As shown in FIG. 1, the liner 13 also includes an internal recess, such as circumferential groove 21, for enegagement by the seal assembly 11. The internal bore 23 of the liner 13 above the groove 21 is typically provided with a smooth or polished surface and has a smaller internal diameter than the internal diameter of the liner 13 at the running threads. The polished bore 23 joins the larger diameter of the running threads 19 to form an internal landing shoulder 25.

The seal assembly 11 of the invention includes a sliding tubular mandrel 27 having an interior bore 29 for conducting well bore fluids, an exterior 31, upper connecting means (not shown) for connection in a well string leading to the well surface, and a lower end 33. The upper connecting means can be identical to the externally threaded surface 35 which joins the lower end 33. As shown in FIG. 1, the lower end 33 is connected by the threaded surface 35 to the remainder of the mandrel 27 to form an external support shoulder 37. It will also be noted that the mandrel exterior 31 has a region of reduced external diameter 39 adjacent to the lower end 33 which defines a setting shoulder 41 (FIG. 2) in the mandrel exterior 31.

A seal body 43 is carried about the mandrel 27 on the support shoulder 37 as the seal assembly 11 is being run into the surrounding conduit 13 and prior to encountering the polished bore 23. The seal body 43 has an external seal region 45 to sealingly engage the interior bore 23 of the surrounding well conduit 13 and an internal seal region 47 for sealingly engaging the mandrel exterior 31. An end ring 49 threadedly engages the upper end of the seal body and retains the seals 45, 47. One or more set screws 51 can be used to secure the end ring 49.

The seal body 43 includes a lower tubular extent 53 which is provided with a plurality of window openings 55. Preferably, there are four window openings provided at one circumferential location about the lower tubular extent 53, the window openings 55 being provided at evenly spaced 90° locations. Each of the window openings 55 is provided with an upper and a lower tapered ramp surface 57, 59. The lower ramp surface 59 forms an angle of approximately 45° with respect to the longitudinal axis of the lower tubular extent 53. The upper ramp surface 57 is similarly, but oppositely tapered.

An upper sleeve 61 and a lower sleeve 63 circumscribe the seal body 43 on either side of the window openings 55 to thereby define a circumferential opening about the seal body 43. The upper and lower sleeves 61, 63 each have interior surfaces 65, 67 respectively, which are spaced-apart from the seal body 43 to define an annular recess (indicated generally at 69 in FIG. 1).

A plurality of latch elements 71 are carried in the circumferential opening 69. Each latch element 71 has an interior (73 in FIG. 2) which is a generally planar, rectangular surface provided with oppositely sloping, upper and lower camming surfaces 75, 77. The latch elements 71 also have an exterior 79 which is also provided with oppositely sloping, upper and lower camming surfaces 81, 83. Camming surface 81 forms an obtuse angle alpha of approximately 135 degrees with respect to the plane of exterior surface 79, as viewed from the side of FIG. 4. The interior camming surfaces 75, 77 are received within the window openings 55 of the seal body 43 with the interior camming surfaces engaging a selected one of the window opening ramp surfaces 57, 59. The latch elements 71 also have upper and lower axial projections 85, 87 which are received in the spaces between the upper and lower sleeves 61, 63 for retaining the latch elements 71 in the annular recess 69.

As shown in FIG. 1, a space exists between the upper axial projection 85 and the interior surface 65 and the upper camming surface 75 engages the upper ramp surface 57 in the running in position. As will described with respect to FIG. 3, a space exists between the upper and lower axial projections 85, 87 and the sleeves 61, 63 and the lower camming surface 77 engages the lower ramp surface 59 as the seal assembly is being retrieved from the well bore. The latch elements 71 are thus movable axially and radially within the widow openings 55.

Spring means, such as coil spring 89 and a spacer ring 91 are located within the annular recess 69 above the latch elements 71. The spring means act against the latch element upper axial projections 85 to force the latch element lower interior camming surfaces 77 into contact with the window opening lower ramp surfaces 59 to bias the latch element radially outward as the seal assembly is run through the enlarged diameter of the pipe string above the polished bore 23.

Figure 3:
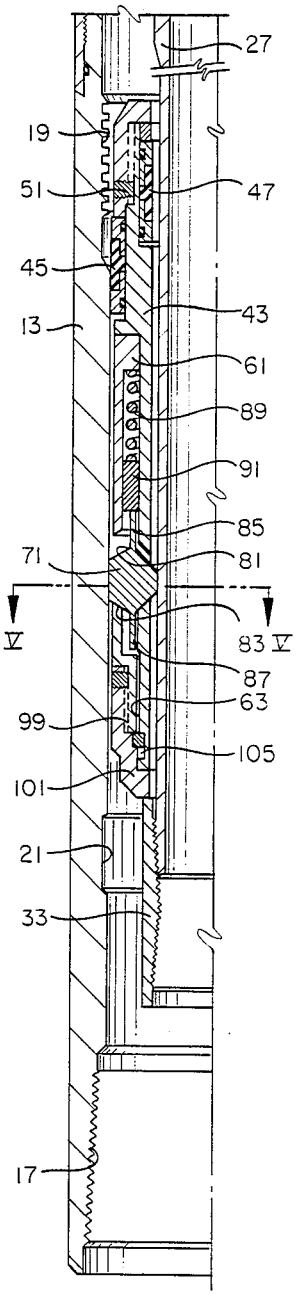
FIG. 3 is a view similar to FIG. 2, but showing the seal assembly being retrieved to the well surface.

As shown in FIGS. 1 and 3, the lower sleeve 63 has a region of lesser internal diameter 93 coupled to a region of greater internal diameter 95 at a shoulder 97. The exterior 99 of the lower sleeve 63 is threaded and matingly engages an end ring 101. A square wire 103 is received in a groove between the end ring 101 and the sleeve portion 63 and protrudes into a recess 105 formed in the interior of the lower tubular extent 53. In this way, the lower sleeve 63 is slideable axially within the recess 105 with respect to the seal body 43.

The lower sleeve 63 is also provided with a tapered lip 107 for engaging the lower camming surface 83 of the latch elements upon upward movement of the mandrel 27 for forcing the latch elements 71 radially inward during retrieval of the seal assembly 11.

The method of installing and retrieving the seal assembly of the invention will now be described. FIG. 1 shows the running-in position of the seal assembly 11 once the seal assembly has entered the polished bore 23 of the surrounding liner 13. Prior to entering the reduced internal diameter of the polished bore 23, the seal assembly rides upon the support shoulder 37 of the lower end 33. The spring means 89 bias the latch elements downwardly against the lower ramp surfaces 59 so that the latch elements 71 are biased radially outward with respect to the seal body 43.

As the seal assembly contacts the reduced internal diameter of the polished bore 23, frictional resistance is encountered between the external seal region 45 and the polished bore 23. The frictional resistance on the seal 45 is approximately three times the total weight of the seal assembly 11. As a result, the sliding mandrel 27 moves to the position shown in FIG. 1 in which the setting shoulder 41 engages the interior 73 of the latch elements 71. As downward force continues to be exerted against the mandrel 27, the seal assembly is pushed downwardly through the polished bore 23 until the internal recess 21 of the liner 13 is encountered. It will be noted that the seal assembly 11 does not abut or locate on the internal landing shoulder 25 of the liner 13, as did the prior art devices.

Figure 2:
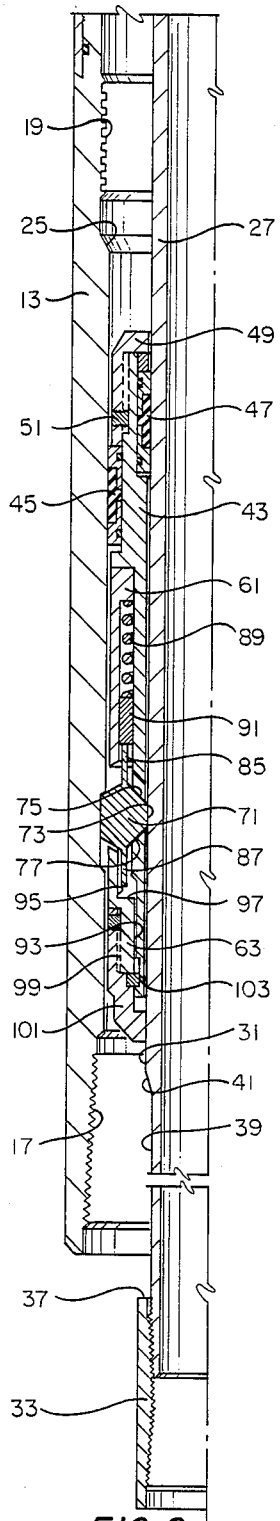
FIG. 2 is a side, cross-sectional view similar to FIG. 1, showing the latch elements of the seal body engaging the internal recess provided in the surrounding well conduit.

As the latch elements 71 encounter the increased diameter of the circumferential groove 21, the spring 89 forces the latch elements radially outward to the relaxed position within the groove (see FIG. 2). The setting shoulder 41 of the sliding mandrel 27 continues downward past the latch element interior 73. As long as a pressure differential exists above and below the seal assembly 11, the seal assembly is mechanically locked in the position shown in FIG. 2. A pressure differential acting from above the seal assembly in the annular space between the mandrel 27 and the liner 13 acts upon the seals 45, 47 and causes the upper ramp surface 57 to urge the latch element 71 radially outward in latching engagement with the surrounding liner. Similarly, a pressure differential acting from below the seal assembly 11 causes the lower ramp surface 59 to contact the lower camming surface 77 of the latch element 71 to force the latch elements radially outward into latching enegagement with the circumferential groove 21.

In order to release the seal assembly of the invention, the sliding mandrel 27 is raised upwardly from the position shown in FIG. 2 to the position shown in FIG. 3. As the lower sleeve tapered lip 107 contacts the lower camming surface 83, the latch element 71 are forced radially inward so that the latch elements can be pulled upwardly past the groove 21. In order to release the seal assembly, it is also necessary that the reduced diameter undercut area 31 on the exterior of the mandrel be long enough to allow pressure to bleed as the undercut area is pulled past the seals 47 (as shown in FIG. 3).

An invention has been provided with several advantages. The seal assembly of the invention is self-locating and does not require the presence of an internal landing shoulder in the surrounding conduit. The unique spring-loaded latch elements find the latching groove in the surrounding conduit and spring into engagement. The load carrying latch elements 71 load ramp surfaces 57, 59 of the seal body 43 and do not exert loading upon the sliding mandrel exterior surface. This design eliminates any possibility of a collapse load on the sliding mandrel and reduces the possibility of damaging the seal elements 47 due to a galled surface on the mandrel 27.

While the invention has been shown in only one of its forms, it is not thus limited but is susceptible to various changes and modifications without departing from the spirit thereof.

I claim:

1. A self-locating seal assembly for sealing between a well string and the bore of a surrounding well conduit, the surrounding conduit being provided with an internal recess for engagement by the seal assembly, comprising:

a mandrel having an interior bore for conducting well bore fluids, an exterior, upper connecting means for connection in a well string leading to the well surface, and a lower end, the lower end being connected to the remainder of the mandrel to form an external support shoulder, and wherein the mandrel exterior has a region of reduced external diameter adjacent the lower end which defines a setting shoulder in the mandrel exterior;

a seal body carried about the mandrel on the support shoulder while running into the well bore, the seal body having an external seal region for sealingly engaging the interior bore of the surrounding well conduit and an internal seal region for sealingly engaging the mandrel exterior, the seal body being provided with a plurality of window openings at one circumferential location, each window opening having an upper and lower tapered ramp surface;

upper and lower sleeve means circumscribing the seal body at spaced locations to thereby define a circumferential opening, each sleeve means having an interior surface which is spaced-apart from the seal body to define an annular recess;

a plurality of latch elements carried by the seal body in the circumferential opening, each latch element having an interior provided with oppositely sloping camming surfaces and an exterior also provided with oppositely sloping camming surfaces, the interior camming surfaces being received within the window openings of the seal body and being engageable with selected ones of the window opening ramp surfaces, whereby the latch elements are movable axially and radially within the window openings; and spring means located within a selected one of the annular recesses for biasing the latch elements radially outward in the direction of the surrounding well conduit and into engagement with the internal recess of the surrounding conduit once the latch elements reach the internal recess of the surrounding conduit as the seal assembly is being run into position within the well bore.

2. A self-locating seal assembly for sealing between a well string and the bore of a surrounding well conduit, the surrounding conduit being provided with an internal recess for engagement by the seal assembly, comprising:

a mandrel having an interior bore for conducting well bore fluids, an exterior, upper connecting means for connection in a well string leading to the well surface, and a lower end, the lower end being connected to the remainder of the mandrel to form an external support shoulder, and wherein the mandrel exterior has a region of reduced external diameter adjacent the lower end which defines a setting shoulder in the mandrel exterior;

a seal body carried about the mandrel on the support shoulder while running into the well bore, the seal body having an external seal region for sealingly engaging the interior bore of the surrounding well conduit and an internal seal region for sealingly engaging the mandrel exterior, the seal body being provided with a plurality of window openings at one circumferential location, each window opening having an upper and lower tapered ramp surface;

an upper sleeve and a lower sleeve circumscribing the seal body at spaced locations on either side of the window openings of the seal body to thereby define a circumferential opening, the upper and lower sleeves each having interior surfaces which are spaced-apart from the seal body to define an annular recess;

a plurality of latch elements carried by the seal body in the circumferential opening, each latch element having an interior provided with oppositely sloping, upper and lower camming surfaces and an exterior also provided with oppositely sloping, upper and lower camming surfaces, the interior camming surfaces being received within the window openings of the seal body with the interior camming surfaces engaging a selected one of the window opening ramp surfaces, whereby the latch elements are movable axially and radially within the window openings; and spring means located within the upper sleeve annular recess for biasing the latch element interior, lower camming surfaces into engagement with the window opening lower ramp surfaces, whereby the latch elements are forced radially outward in the direction of the surrounding well conduit and into engagement with the internal recess of the surrounding conduit once the latch elements reach the internal recess of the surrounding conduit as the seal assembly is being run into position within the well bore.

3. The seal assembly of claim 2, wherein the mandrel setting shoulder is engageable with the, interior upper camming surfaces of the latch elements upon initial downward movement of the mandrel to thereby force the latch elements radially outward in the direction of the surrounding well conduit as the seal assembly is being run into position within the well bore.

4. The seal assembly of claim 3, wherein the lower sleeve which circumscribes the seal body is slideable axially with respect to the seal body, the lower sleeve being provided with a tapered lip for engaging the exterior, lower camming surfaces of the latch elements upon upward movement of the mandrel for forcing the latch elements radially inward during retrieval of the seal assembly.

5. The seal assembly of claim 4, wherein the latch elements have upper and lower axial projections which are received in the annular recesses between the upper and lower sleeves for retaining the latch elements in the annular recesses.

6. The seal assembly of claim 5, wherein the spring means is a coil spring located in the, upper sleeve annular recess, and whereby the spring acting against the latch element upper axial projections forces the latch element lower interior camming surfaces to contact the window opening lower ramp surfaces to bias the latch elements radially outward.

* * * * *